US008118956B2

(12) United States Patent
Morgan et al.

(10) Patent No.: US 8,118,956 B2
(45) Date of Patent: Feb. 21, 2012

(54) MANUFACTURE OF PYROTECHNIC TIME DELAY COMPOSITIONS

(75) Inventors: Clifford Gordon Morgan, Kempton Park (ZA); Craig Rimmington, Edenvale (ZA)

(73) Assignee: AEL Mining Services Limited, Woodmead (ZA)

( * ) Notice: Subject to any disclaimer, the term of this patent is extended or adjusted under 35 U.S.C. 154(b) by 88 days.

(21) Appl. No.: 12/442,107

(22) PCT Filed: Sep. 20, 2007

(86) PCT No.: PCT/IB2007/053780

§ 371 (c)(1),
(2), (4) Date: Mar. 19, 2009

(87) PCT Pub. No.: WO2008/035288

PCT Pub. Date: Mar. 27, 2008

(65) Prior Publication Data

US 2010/0037999 A1 Feb. 18, 2010

(30) Foreign Application Priority Data

Sep. 20, 2006 (ZA) ..... 2006/07885

(51) Int. Cl.
*D03D 23/00* (2006.01)
*D03D 43/00* (2006.01)

(52) U.S. Cl. ..... 149/108.2; 149/108.6; 149/109.2; 149/109.6

(58) Field of Classification Search ..... 149/108.2, 149/108.6, 109.2, 109.6
See application file for complete search history.

(56) References Cited

U.S. PATENT DOCUMENTS

| | | | | |
|---|---|---|---|---|
| 2,560,452 | A * | 7/1951 | Kerr et al. | 149/37 |
| 2,717,204 | A | 9/1955 | Noddin et al. | |
| 3,111,438 | A | 11/1963 | Ball et al. | |
| 3,570,403 | A | 3/1971 | Hawley et al. | |
| 3,881,420 | A | 5/1975 | Smith et al. | |
| 3,886,009 | A | 5/1975 | Puchalski | |
| 4,130,061 | A | 12/1978 | Boggs et al. | |
| 4,757,764 | A | 7/1988 | Thureson et al. | |
| 5,322,018 | A | 6/1994 | Hadden et al. | |
| 6,170,398 | B1 | 1/2001 | Rabotinsky et al. | |
| 6,347,566 | B1 | 2/2002 | Rabotinsky et al. | |
| 6,416,600 | B1 * | 7/2002 | Clarke et al. | 149/109.6 |

(Continued)

FOREIGN PATENT DOCUMENTS

DE 195 01 889 A1 7/1995

(Continued)

OTHER PUBLICATIONS

Don W. Green et al., "Perry's Chemical Engineers' Handbook Sixth Edition," 1985, McGraw-Hill Book Company, New York, U.S., pp. 20-65-pp. 20-58.

(Continued)

*Primary Examiner* — James McDonough
(74) *Attorney, Agent, or Firm* — Knobbe Martens Olson & Bear LLP

(57) ABSTRACT

A method of manufacturing a pyrotechnic time delay composition includes admixing together a solid oxidizer, a solid fuel and water to form an aqueous slurry. The slurry is transformed into droplets. The droplets are gas-dried to form particles comprising the oxidizer and the fuel, with the particles thus constituting a pyrotechnic delay composition.

22 Claims, 1 Drawing Sheet

U.S. PATENT DOCUMENTS

| | | | | |
|---|---|---|---|---|
| 6,436,211 | B1 * | 8/2002 | Mendenhall et al. | 149/109.6 |
| 2008/0190525 | A1 * | 8/2008 | Wagaman | 149/45 |

FOREIGN PATENT DOCUMENTS

| | | | |
|---|---|---|---|
| DE | 19501889 | | 7/1995 |
| EP | 0 310 580 | A | 4/1989 |
| EP | 0 310 580 | B1 | 4/1989 |
| EP | 0 332 986 | A | 9/1989 |
| EP | 0 332 986 | B1 | 9/1989 |
| EP | 0 599 792 | A | 6/1994 |
| EP | 0 599 792 | B1 | 6/1994 |
| EP | 0 699 645 | | 3/1996 |
| EP | 0 699 645 | A | 3/1996 |
| EP | 0 735 013 | A | 10/1996 |
| EP | 0735 013 | A1 | 10/1996 |
| GB | 2 070 581 | A | 9/1981 |
| GB | 2 089 336 | A | 6/1982 |
| WO | WO 02/072504 | A | 9/2002 |
| WO | WO 02/072504 | A1 | 9/2002 |

OTHER PUBLICATIONS

Green et al., "Perry's Chemical Engineers' Handbook Sixth Edition", 1985, McGraw-Hill Book Company, pp. 20-54-pp. 20-58.

* cited by examiner

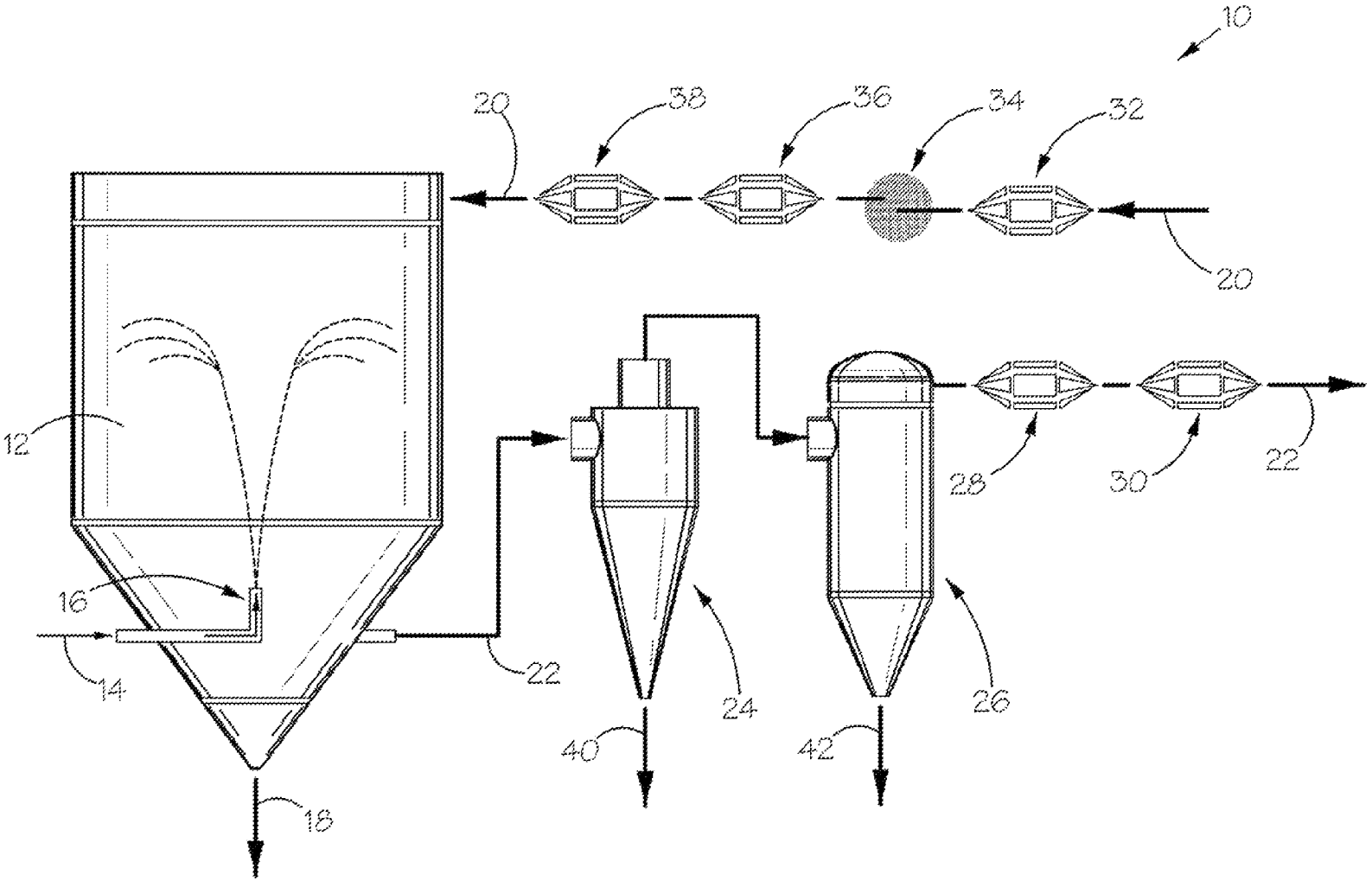
10
20
32
34
36
38
20
22
30
28
26
42
24
40
22
18
14
16
12

MANUFACTURE OF PYROTECHNIC TIME DELAY COMPOSITIONS

THIS INVENTION relates, broadly, to the manufacture of pyrotechnic time delay compositions, of the type used, for example, in delay elements employed for the initiation of explosives. More particularly, the invention relates to a method of manufacturing such compositions, and to such compositions when made in accordance with the method.

According to the invention, broadly, there is provided a method of manufacturing a pyrotechnic time delay composition, the method including admixing together a solid oxidizer, a solid fuel and water to form an aqueous slurry;

transforming the slurry into droplets; and gas-drying the droplets to form particles comprising the oxidizer and the fuel, with the particles constituting a pyrotechnic delay composition.

A surfactant may be present during the admixing of the oxidizer, the fuel and the water to form the slurry. It is expected that routine experimentation can be employed to select desirable or appropriate surfactants, and the proportions thereof to be used, to facilitate formation of an aqueous slurry of suitable consistency for the intended atomisation and gas-drying. An example of a suitable surfactant is a wetting agent such as an acrylic ester, a styrene polymer, and/or an acrylic copolymer. The wetting agent, when present, may be used in proportions amounting to 0.25-4% by mass of the slurry. Another example of a suitable surfactant is a rheology modifier or a thickening agent such as polyethylene glycol, carboxymethyl cellulose, polyvinyl alcohol, polyvinyl pyrrolidone and powdered smectite clay. The rheology modifier, when present, may be used in proportions of 0.25-4% by mass of the slurry.

The admixing of the oxidizer, the fuel and the water may be by using high-shear mixing techniques, such as those used in the paint industry for the high-shear mixing of paints. In this regard a Silverson Abramix high-shear mixer (obtainable in South Africa from Stewart and Brierly (Pty) Limited of 71 2$^{nd}$ Street, Booysens, Johannesburg) has been found to be suitable for use on a laboratory scale.

More or less conventional oxidizers may be employed such as, for example, red lead and/or barium sulphate, in particulate form. The oxidizer may comprise 24-54%, by mass, of the slurry. More typically, the oxidizer may comprise 30-50%, by mass, of the slurry. More or less conventional fuels such as silicon, zinc and/or magnesium, in particulate form, may be employed. The fuel may comprise 5-50%, by mass, of the slurry. More typically, the fuel may comprise 7-40%, by mass, of the slurry. The proportion of water in the slurry may be 30-70% by mass. More typically, the proportion of water in the slurry may be 40-50% by mass.

Transforming the slurry into the droplets may include atomizing the slurry. The method may include spray-drying the slurry, thereby to achieve the atomization of the slurry into the droplets and the gas-drying of the slurry droplets. The atomization may include pumping the slurry at suitably high pressure, eg in the range of 500-2500 kPa, through an orifice in a nozzle to achieve atomising of the slurry, the orifice typically being circular and having a diameter selected to achieve such atomising. Instead, the atomization may include pumping the slurry at a low pressure, e.g. at a pressure of 10-100 kPa, through an orifice in a so-called two fluid nozzle, the orifice typically being circular and being selected to suit the drying capacity required for the slurry in question. A so-called two fluid nozzle is designed so that the additional introduction of compressed air achieves the desired atomization. The size of the orifice in the nozzle is determined by the desired spray pattern and the slurry viscosity; however, typically, it has a diameter of 1.5 mm or 2 mm. The pressure of the compressed air used to achieve the desired atomization is dependent on the viscosity of the slurry; however, typically the compressed air pressure can be around 200-300 kPa, to maximize particle size. Higher compressed air pressures will result in smaller particle sizes. Instead, the atomization may include allowing the slurry to impinge on a rotating disc whereby high-velocity centrifugal forces generated by the rotating disc are used to form droplets of the slurry in the gas stream. In each case the atomization may be effected in the presence of a heated gas stream. Thus, when an orifice is used to form droplets as hereinbefore described, the droplets exiting the orifice will contact the heated gas stream, thereby to be dried by the heated gas. When the droplets are formed by means of a rotating disc as hereinbefore described, the droplets formed by the rotating disc will contact the heated gas stream, thereby to be dried by the heated gas.

The gas may thus be at an elevated temperature. The gas may be air, preferably heated air.

In each case, the atomisation will thus act to form the droplets in the heated air stream, with the heated air serving to dry the droplets. In each case, the atomization may be affected in a chamber having an air inlet and an air outlet. The heated air may then, for example, have an inlet temperature of 190° C. to 240° C., typically about 210° C. The air will typically have an outlet temperature of 110° C. The stream of hot air will thus pass through the chamber, e.g. lengthwise along the interior of a cylindrical chamber, acting to dry the particles while it is cooled down. In each case, it is expected that the water in the droplets will evaporate rapidly over a period of 1-40 seconds, to form more or less spherical particles comprising the oxidizer and the fuel more or less homogeneously mixed and dried, and having a moisture content of at most 1% by mass, typically 0.1%-0.8%. Such particles are suitable for use as a pyrotechnic delay composition.

Introducing the droplets into the stream of air may be either co-current or counter-current, as desired, to obtain acceptable air/droplet contact times and drying times.

The invention extends also to a pyrotechnic time delay composition, when manufactured by the method as hereinbefore described.

It is expected that substantial advantages of the invention will be that it avoids the environmental difficulties associated with organic solvents employed in the admixing, while avoiding or reducing any need for classification of product particles to eliminate or reduce the proportion of undersize and/or oversize particles. Furthermore, aqueous slurries are expected to be sufficiently safe to permit the use of high-shear mixers for slurry formation, leading to quick and efficient slurry production.

The invention will now be described, by way of non-limiting illustrative example, with reference to the following Examples and the following schematic drawing, in which the single FIGURE shows a diagrammatic side elevation, in more or less block-diagram format, of an installation for carrying out the method of the present invention.

In the drawing, the installation is generally designated by the reference numeral 10 and comprises a spray-drying chamber 12. The chamber 12 is shown provided with a slurry feed line 14 terminating in a centrally positioned, upwardly directed two fluid spray nozzle 16 having a 1.5 mm or 2 mm diameter orifice. The chamber 12 has a cylindrical upper portion and a downwardly tapering conical lower portion which terminates in a solids outlet line 18. An air feed line 20 is shown feeding tangentially in to the top of the cylindrical upper portion of the chamber 12. The chamber 12 will typically be fitted with an explosion relief panel, to relieve any pressure generated should an ignition occur in the chamber, thereby limiting any damage to the chamber only. Such an explosion relief panel will typically be designed to release pressure at 10 kPa when the chamber has a design pressure of 60 kPa.

The chamber 12 has an air outlet line 22 shown feeding successively through a powder separation cyclone 24, a bag filter 26 and a pair of ancillary filters 28, 30 to the atmosphere. In turn, the air feed line 20 is shown feeding successively through a pre-filter 32, a fan 34, a heater 36 and a filter 38.

EXAMPLE 1

An aqueous slurry for a pyrotechnic time delay composition was prepared having the following composition in terms of solids on a dry basis:

| Constituent | Proportion (% by mass) |
|---|---|
| red lead particles (d50 approx. 3 μm) (oxidizer) | 38.25 |
| barium sulphate particles (d50 approx. 3 μm) (oxidizer) | 54.25 |
| silicon particles (d50 approx. 3 μm) (fuel) | 7 |
| smectite clay particles (BENTONE ®EW) (rheology modifier/thickener) | 0.5 |
| Total | 100 |

All four the dry particulate constituents were homogeneously mixed with water to form a slurry in which the water formed 50% by mass, with the solids thus forming 50%. The BENTONE® EW smectite clay particles were obtained from Carst & Walker (Pty) Limited of Zenith House, 12 Sherborne Road, Parktown, Johannesburg, South Africa. The slurry was pumped, at a low pressure of 10-100 kPa, along the feed line 14 and through the orifice of the nozzle 16 (together with compressed air), thereby being atomized and thus formed into droplets, while low pressure air at a temperature of 210° C. was fed into the chamber 12 via the filters 32 and 38 and via the heater 36, by the fan 34, to dry the droplets. Spray-drying thus took place in the chamber 12 to form more or less spherical dried particles of more or less homogeneous composition. These particles had a moisture content of about 0.1% by mass and remained in the chamber 12 for a period of 1-40 seconds. The dried particles were collected from the solids outlet line 18, while the drying air, which issued from the chamber 12 at 80° C. via outlet line 22, was cleaned by the cyclone 24 and filters 26, 28 and 30, dried particles being collected from the cyclone outlet line 40 and dried fines being collected from the outlet line 42 of the bag filter 26.

The dried product from the line 18 was found to comprise acceptably low proportions of both oversize and undersize particles which could be used, without additional classifying, as a pyrotechnic time delay composition in the manufacture of pyrotechnic time delay elements. The method was found to be safe, quick, efficient and pollution-free.

EXAMPLE 2

| Constituent | Proportion (% by mass) |
|---|---|
| barium sulphate particles (d50 approx. 3 μm) (oxidizer) | 54.75 |
| silicon particles (d50 approx. 3 μm) (fuel) | 44.75 |
| smectite clay particles (BENTONE ®EW) (rheology modifier/thickener) | 0.5 |
| Total | 100 |

All three the dry particulate constituents were homogeneously mixed with water to form a slurry in which the water formed 50% by mass, with the solids thus forming 50%. The slurry was pumped, at a low pressure of 10-100 kPa, along the feed line 14 and through the orifice of the nozzle 16 (together with compressed air) thereby being atomized and thus formed into droplets, while low pressure air at a temperature of 210° C. was fed into the chamber 12 via the filters 32 and 38 and via the heater 36, by the fan 34, to dry the droplets. Spray-drying thus took place in the chamber 12 to form more or less spherical dried particles of more or less homogeneous composition. These particles had a moisture content of about 0.1% by mass and remained in the chamber 12 for a period of 1-40 seconds. The dried particles were collected from the solids outlet line 18, while the drying air, which issued from the chamber 12 at 80° C. via outlet line 22, was cleaned by the cyclone 24 and filters 26, 28 and 30, dried particles being collected from the cyclone outlet line 40 and dried fines being collected from the outlet line 42 of the bag filter 26.

As was the case in Example 1, the dried product from the line 18 was found to comprise acceptably low proportions of both oversize and undersize particles which could be used, without additional classifying, as a pyrotechnic delay composition in the manufacture of pyrotechnic time delay elements. As before the method was found to be safe, quick, efficient and pollution-free.

Conventionally, in pyrotechnic time delay compositions, an oxidizer such as red lead is used to impart sensitivity to the composition, particularly to compositions having a slow burning rate, e.g. about 210 ms/mm. It has thus unexpectedly been found that, by employing the method according to the invention to manufacture a pyrotechnic time delay composition, it is possible to eliminate the use of red lead, which is desirable due to the hazardous nature of red lead, while still obtaining acceptable burning rates.

Furthermore, it is important that the surfactant used is such that little or no gas is generated by the surfactant when the composition burns. Gas generated by the burning surfactant could lead to malfunctioning of a delay element incorporating the composition.

The invention claimed is:

1. A method of manufacturing a slow-burning pyrotechnic time delay composition, wherein the method includes:

admixing together, under high shear and in the absence of a sensitizing oxidizer, a solid oxidizer, a solid fuel and water to form an aqueous slurry;

transforming the slurry into droplets; and gas-drying the droplets to form particles comprising the solid oxidizer and the fuel, with the particles thus constituting the pyrotechnic delay composition.

2. The method according to claim 1, wherein a surfactant is present during the admixing of the oxidizer, the fuel and the water to form the slurry.

3. The method according to claim 2, wherein the surfactant is a wetting agent, and is selected from the group consisting of an acrylic ester, a styrene polymer, and an acrylic copolymer.

4. The method according to claim 3, wherein the wetting agent comprises 0.25% to 4%, by mass, of the slurry.

5. The method according to claim 2, wherein the surfactant is a rheology modifier and is selected from the group consisting of polyethylene glycol, polyvinyl alcohol, polyvinyl pyrrolidone, carboxymethyl cellulose and powdered smectite clay.

6. The method according to claim 5, wherein the rheology modifier comprises 0.25% to 4%, by mass, of the slurry.

7. The method according claim 1, wherein the solid oxidizer is barium sulphate, and comprises 24%-54%, by mass, of the slurry.

8. The method according to claim 1, wherein the fuel is silicon, zinc and/or magnesium and comprises 5%-50% by mass, of the slurry.

9. The method according to claim 1, wherein the slurry comprises 40% to 80% water by mass.

10. The method according to claim 1, wherein transforming the slurry into droplets includes atomizing the slurry.

11. The method according to claim 10, which includes spray drying the slurry, thereby to achieve the atomization of the slurry into droplets and the gas-drying of the slurry droplets.

12. The method according to claim 11, wherein the atomization of the slurry includes pumping the slurry at a high pressure through an orifice in a nozzle into a heated gas stream.

13. The method according to claim 11, wherein the atomization of the slurry includes pumping the slurry at a low pressure through an orifice in a two fluid nozzle into a heated gas stream.

14. The method according to claim 11, wherein the atomization of the slurry includes allowing the slurry to impinge on a rotating disc in the presence of a heated gas stream whereby high-velocity centrifugal forces generated by the rotating disc are used to form droplets in the gas stream.

15. The method according to claim 11, wherein the gas stream is a heated gas stream so that the gas-drying of the slurry droplets is thus achieved through contact of the slurry droplets with the heated gas stream.

16. The method according to claim 11, wherein the gas stream is air, which is at a temperature of about 240° C.

17. The method according to claim 16, wherein the atomization of the slurry is effected in a chamber through which the air passes.

18. The method according to claim 16, wherein the water in the slurry droplets evaporates over a period of 1 to 40 seconds, forming more or less spherical particles having a moisture content of up to 1%, by mass.

19. The method according to claim 1, wherein the pyrotechnic time delay composition has a burning rate of about 210 ms/mm.

20. The method according to claim 1, wherein the gas-drying comprises gas-drying the droplets in heated air.

21. A method of manufacturing a pyrotechnic time delay composition, wherein the method includes:

admixing together a solid oxidizer, a solid fuel and water, in the presence of a wetting agent selected from the group consisting of an acrylic ester, a styrene polymer, and an acrylic copolymer, thereby to form an aqueous slurry;

transforming the slurry into droplets; and gas-drying the droplets to form particles comprising the oxidizer and the fuel, with the particles thus constituting a pyrotechnic delay composition.

22. The method according to claim 21, wherein the wetting agent comprises 0.25% to 4%, by mass, of the slurry.

* * * * *

UNITED STATES PATENT AND TRADEMARK OFFICE

CERTIFICATE OF CORRECTION

PATENT NO. : 8,118,956 B2
APPLICATION NO. : 12/442107
DATED : February 21, 2012
INVENTOR(S) : Morgan et al.

It is certified that error appears in the above-identified patent and that said Letters Patent is hereby corrected as shown below:

At page 1 (Item 22) PCT Filed, Line 1, please change "Sep. 20, 2007" to --Sep. 19, 2007--.

Signed and Sealed this
Fourth Day of September, 2012

David J. Kappos

David J. Kappos
*Director of the United States Patent and Trademark Office*